US005818338A

United States Patent [19]

Ferraro

[11] Patent Number: 5,818,338

[45] Date of Patent: Oct. 6, 1998

[54] FLOOD LIGHT LAMP REMOVAL ALARM

[76] Inventor: Joseph C. Ferraro, 150 Central Ave., Farmingdale, N.Y. 11735

[21] Appl. No.: 835,200

[22] Filed: Apr. 7, 1997

Related U.S. Application Data

[63] Continuation-in-part of Ser. No. 537,262, Sep. 29, 1995, Pat. No. 5,619,185.

[60] Provisional application Nos. 60/000,264 Jun. 16, 1995 and 60/000,338 Jun. 20, 1995.

[51] Int. Cl.[6] ..... G08B 13/14

[52] U.S. Cl. ..... 340/568; 340/571; 340/643; 340/539; 340/660; 340/661; 340/664; 340/641; 340/642; 315/129

[58] Field of Search ..... 340/568, 571, 340/541, 506, 643, 539, 660, 661, 664, 641, 642; 315/129, 130, 131, 132, 133

[56] References Cited

U.S. PATENT DOCUMENTS

| | | | |
|---|---|---|---|
| 3,289,194 | 11/1966 | King | 340/568 |
| 3,382,494 | 5/1968 | Mahacsek | 340/568 |
| 3,944,889 | 3/1976 | Conway | 340/641 |
| 3,975,627 | 8/1976 | Huber | 362/377 |
| 4,021,679 | 5/1977 | Bolle et al. | 340/562 |
| 4,295,079 | 10/1981 | Otsuka | 315/130 |
| 4,369,435 | 1/1983 | Adachi | 340/506 |
| 4,396,868 | 8/1983 | Watanabe | 315/130 |
| 4,422,068 | 12/1983 | Helft | 340/514 |
| 4,438,431 | 3/1984 | Toyomura | 340/663 |
| 4,447,806 | 5/1984 | Gundel et al. | 340/641 |
| 4,550,303 | 10/1985 | Steele | 340/641 |
| 4,700,126 | 10/1987 | Hill | 324/510 |
| 4,812,827 | 3/1989 | Scripps | 340/693 |
| 4,936,789 | 6/1990 | Ugalde | 439/236 |
| 4,945,341 | 7/1990 | Buttiimer | 340/568 |
| 4,980,672 | 12/1990 | Murphy | 340/571 |
| 5,034,659 | 7/1991 | Taniguchi | 315/131 |
| 5,041,761 | 8/1991 | Wright et al. | 315/129 |
| 5,099,177 | 3/1992 | Taniguchi | 315/130 |
| 5,155,474 | 10/1992 | Park et al. | 340/691 |
| 5,160,000 | 11/1992 | Agha | 190/102 |
| 5,168,198 | 12/1992 | Watanabe | 315/130 |
| 5,172,098 | 12/1992 | Leyden | 340/568 |
| 5,266,920 | 11/1993 | Langner | 340/384.3 |
| 5,293,115 | 3/1994 | Swanson | 324/110 |
| 5,359,325 | 10/1994 | Ford | 340/953 |
| 5,387,909 | 2/1995 | Neel | 340/931 |
| 5,406,129 | 4/1995 | Gilmartin | 307/125 |
| 5,434,558 | 7/1995 | Zeder | 340/568 |

*Primary Examiner*—Jeffery A. Hofsass
*Assistant Examiner*—Benjamin C. Lee
*Attorney, Agent, or Firm*—Alfred M. Walker

[57] ABSTRACT

A flood light lamp removal alarm for security lights mounted on or near a home, wherein the lights are designed to turn on automatically if a motion detector is triggered and the ambient light level is low, detects if any of the flood light lamps are unscrewed or loosened, either prior to a burglary or during the attempt to disable the flood light assembly. A central contact of a lamp socket is modified so that it maintains contact with the lamp therein for a longer distance as the lamp is unscrewed out, so that the alarm is triggered before the light from the lamp is disabled. Alternatively, current detectors verify when a lamp is loosened from a socket by detecting changes in current draw across the socket.

10 Claims, 8 Drawing Sheets

FLOOD LIGHT LAMP REMOVAL ALARM

RELATED CASES

This application is a continuation-in-part of application Ser. No. 08/537,262, filed Sep. 29, 1995, now U.S. Pat. No. 5,619,185 of Apr. 8, 1997, which is further based upon provisional application Ser. No. 60/000,264, dated Jun. 15, 1995 and provisional application Ser. No. 60,000,338 dated Jun. 20, 1995.

FIELD OF THE INVENTION

The present invention relates to a home security device.

BACKGROUND OF THE INVENTION

Many homeowners have security lights mounted on or near their home. Some of these lights are designed to turn on automatically if a motion detector is triggered and the ambient light level is low. These lights are a deterrent to burglary. Unfortunately, they can be easily defeated if the lamps are unscrewed or loosened either prior to the burglary or during the attempt.

In addition, if the lights are loosened by natural forces, such as vibrations from passing heavy trucks, etc., abrupt jarring motions, such as foundation loosening, machinery movement, sound, repetitive motions etc., then the lamps will also be loosened. Moreover, a loosened lamp would not be noticed during daylight hours.

Various attempts have been made to provide lamp failure devices. U.S. Pat. No. 5,099,177 of Taniguchi discloses a lamp circuit with disconnected lamp detecting device. U.S. Pat. No. 4,980,672 of Murphy discloses an overhead socket smoke detector with theft alarm.

U.S. Pat. Nos. 4,396,868 and 5,168,198 of Watanabe discloses a lamp circuit with disconnected lamp detecting device and a lamplight failure detection system respectively. U.S. Pat. No. 5,359,325 of Ford discloses an automatic monitoring system for airfield lighting systems.

Furthermore, U.S. Pat. No. 5,387,909 of Neel discloses a lamp sensing system for traffic light. In addition, U.S. Pat. No. 5,034,659 of Taniguchi describes a lamp circuit with a disconnected lamp detecting device. U.S. Pat. No. 4,700,126 of Hill shows a vehicular lamp circuit tester.

Moreover, U.S. Pat. No. 4,438,421 of Toyomura discloses an electronic device having a warning means and U.S. Pat. No. 4,295,079 of Otsuka describes a lamp circuit with a disconnected lamp detecting device. U.S. Pat. No. 4,422,068 of Helft discloses an intrusion alarm system for preventing actual confrontation with an intruder.

In addition, U.S. Pat. No. 3,975,627 of Huber shows a burglar-proof guard for light bulbs and U.S. Pat. No. 4,936,789 of Ugalde shows a method and apparatus for preventing the theft of a fluorescent lamp and ballast transformer.

Among other prior art includes U.S. Pat. No. 4,812,827 of Scripps which describes a detector and light assembly and U.S. Pat. No. 5,406,129 of Gilmartin which describes a flashing locator switch control with built-in lamp operation test.

Other prior art includes U.S. Pat. No. 3,382,494 of Mahacsek which describes a theft alarm for an electrical device; U.S. Pat. No. 4,021,679 of Bolle et al., which describes a method and apparatus for automatic switching; U.S. Pat. No. 4,369,435 of Adachi et al., which describes a fire detector and fire alarm system having circuitry to detect removal of one or more detectors at a signal station; U.S. Pat. No. 5,155,474 of Park et al., which describes a photographic security system; U.S. Pat. No. 5,160,000 of Agha et al., which describes an attache and umbrella carrying case; U.S. Pat. No. 5,172,098 of Leyden et al., which describes an alarm system sensing and triggering apparatus; U.S. Pat. No. 5,266,920 of Langner which describes a magnet for use on a refrigerator or the like; U.S. Pat. No. 5,293,115 of Swanson which describes a method and system for sensing removal of a utility meter from its socket; and U.S. Pat. No. 5,434,558 of Zeder which describes an annunciator apparatus for monitoring electrical connections.

While the prior art teaches a variety of methods for failed lamp detection and even an alarm for detecting removal of a smoke detector from a socket, the applications are very specialized.

In contrast to the prior art, the present invention sets off an audible or silent alarm when an ordinary bulb or flood lamp is loosened or removed from the socket of a single or multi-lamp security light fixture. Furthermore, the alarm remains on or otherwise indicates that an incident had occurred even if the lamp is immediately retightened in its socket. This action is achieved using inexpensive switch elements and electronic subsystems consistent with the product cost limitations dictated by this consumer market.

In other embodiments, the present invention allows the alarm to be set off even before a bulb is removed from a socket, while still lit. The present invention can also detect removal of a lamp by detecting changes in current in the lamp socket.

OBJECTS OF THE INVENTION

It is therefore an object of the present invention to provide a home security device which detects unwarranted removal of a flood light lamp.

It is yet another object to provide a flood light lamp removal alarm which is a deterrent to burglary.

It is yet a further object to provide a flood light lamp removal alarm which is activated if the lamps are unscrewed or loosened, either prior to a burglary or during an attempt to disable the flood light assembly.

It is yet another object to provide a flood light lamp removal alarm which detects if lights are loosened by natural forces, such as vibrations from passing heavy trucks, etc., abrupt jarring motions, such as foundation loosening, machinery movement, sound, repetitive motions etc.

It is yet another object to provide a flood light lamp removal alarm which causes a discernible alarm to go on, thereby startling a burglar and alerting the neighbors if a lamp is unscrewed from a security light.

Another object of this invention is to modify the central contact of a lamp socket so that it maintains contact with the lamp for a longer distance as the lamp is unscrewed. This would insure that the removal alarm switch is triggered before the light from the lamp is disabled.

Another object of this invention is to modify the central contact of a lamp socket so that it maintains contact with the lamp until the lamp is totally unscrewed from the socket. The lamp would not be disabled simply by loosening it.

A further object of this invention is to detect current draw by the lamps and send this signal to a controller so that an alarm is set off if no current is drawn by a lamp after the motion detector had signaled to switch on the power to the lamps. This would detect missing lamps, loosened lamps as well as burned out lamps.

Yet another object of this invention is to use a combination of a motion detector with auxiliary battery and radio transmitter in a distributed lamp security system along with current sensors to detect tampering with the lamp fixture even if the power line to the motion detector is severed.

It is yet another object to improve over the disadvantages of the prior art.

SUMMARY OF THE INVENTION

In keeping with these objects and others which may become apparent, the present invention includes a flood light lamp removal alarm for security lights mounted on or near a home, wherein the lights are designed to turn on automatically if a motion detector is triggered and the ambient light level is low. The alarm detects if any of the flood light lamps are unscrewed or loosened, either prior to a burglary or during the attempt to disable the flood light assembly.

The alarm can also be used for other lighting fixtures, wherein a lamp is screwed into a socket, such as in a decorative lighting system, an industrial building, or a signaling system, and the like.

In the preferred embodiment, the central contact of a lamp socket is modified so that it maintains contact with the lamp therein for a longer distance as the lamp is screwed out, so that the alarm is triggered before the light from the lamp is disabled.

In yet another embodiment, current detectors verify when a lamp is loosened from a socket by detecting changes in current draw across the socket.

In addition, the alarm also detects if the lights are loosened by natural forces, such as vibrations from passing heavy trucks, etc., abrupt jarring motions, such as foundation loosening, machinery movement, sound, repetitive motions etc.

If one or more lamps are loosened, the alarm of the present invention causes the discernible alarm to go on, thereby startling a burglar and alerting the neighbors if a flood light lamp is unscrewed from a security light while the switch inside the house is turned on, regardless of whether the lamp is on or off.

A housing is provided for the alarm, wherein the housing contains control circuitry and a discernible alarm, such as an audio alarm, for example, an electronic sound generator. The electronic sound generator may be an oscillator or siren type of sound generator, or either a magnetic or piezoelectric sound transducer or loudspeaker.

The trigger for the alarm may be a detection device with a snap action switch, which is activated by an insulating rod. The insulating rod is physically pushed by the lamp base when the lamp base is properly screwed into the socket. The alarm is activated when the detection rod is pushed away by the restoring spring in the switch.

In the alternate, the snap action switch can be replaced by a photodetector in the lamp socket which detects the proper position of the lamp.

The alarm is powered by a low voltage DC power supply formed by a transformer connected at one side to a 120 volt AC power supply and on the other side to a diode and capacitor connected to a plurality of switches, such as single pole, single throw (SPST) switches located within the lamp sockets. The switches are wired in parallel so that any of the switches can turn on the alarm, if any bulb is removed in an unauthorized manner.

In an alternate embodiment, the flood light lamp removal alarm may be remotely placed away from the lamp fixture, such as with a wireless communication device.

The lamp sockets may alternately include a compressive switch for detecting the lamps of a flood light lamp fixture. In the compressive switch, contacts are provided such that the contacts close when the lamp is properly screwed into the socket.

Therefore, a simple in-socket switch is provided within each socket, to detect the unwarranted loosening or removal of any flood light lamps of a home security flood light assembly.

In a preferred embodiment, the means for detecting removal of the lamp includes a physical condition sensor within each socket. The physical condition sensor is inactivated when the lamp is properly screwed into said socket, and the physical condition sensor is activated when the lamp starts to be loosened or removed from the socket. Preferably, the socket is provided with a resilient electrical contact member for maintaining lamp-illuminating electrical contact during the partial removal of the lamp from the socket.

To an unsuspecting vandal, even partial removal of a flood light lamp triggers the lamp removal alarm, even while the partially removed lamp remains illuminated by electrical contact with the resilient contact member.

The resilient electrical contact member may include an elongated leaf spring for maintaining electrical contact with a lamp during the loosening or partial withdrawal of the lamp from the socket.

The resilient electrical contact member can also be an electrically conductive coil spring, having a central electrical contact member, such as an upwardly extending rod, in combination with and surrounded by an electrically insulating compressible sleeve, such as a bellows or a telescopic cylinder.

The coil spring and sleeve combination is mounted within the socket for extensible electrical contact of the lamp with the central contact member, for providing illuminating current during partial removal of the lamp from the socket.

The physical condition sensor means can also include an electric circuit separate from the lamp illuminating electrical circuit. The physical condition sensor circuit may have a switch having an electrically insulated narrow actuator rod disposed in the bottom of the socket and the narrow actuator rod may have a "throw" member and may be compressible when pressed upon by a fully seated and tightened lamp in the socket. The switch may have a no-alarm condition when the narrow actuator rod is depressed by a fully-seated lamp and the switch may have an alarm condition when the narrow actuator rod is not compressed due to the absence of a fully seated condition of the lamp.

In other embodiments, the physical condition sensor may be a current detector, such as a Hall effect switch, detecting changes in current in the socket when a lamp is removed.

DESCRIPTION OF THE DRAWINGS

The present invention can best be understood in conjunction with the accompanying drawings, in which.

DESCRIPTION OF THE PREFERRED EMBODIMENTS

Figure 1:
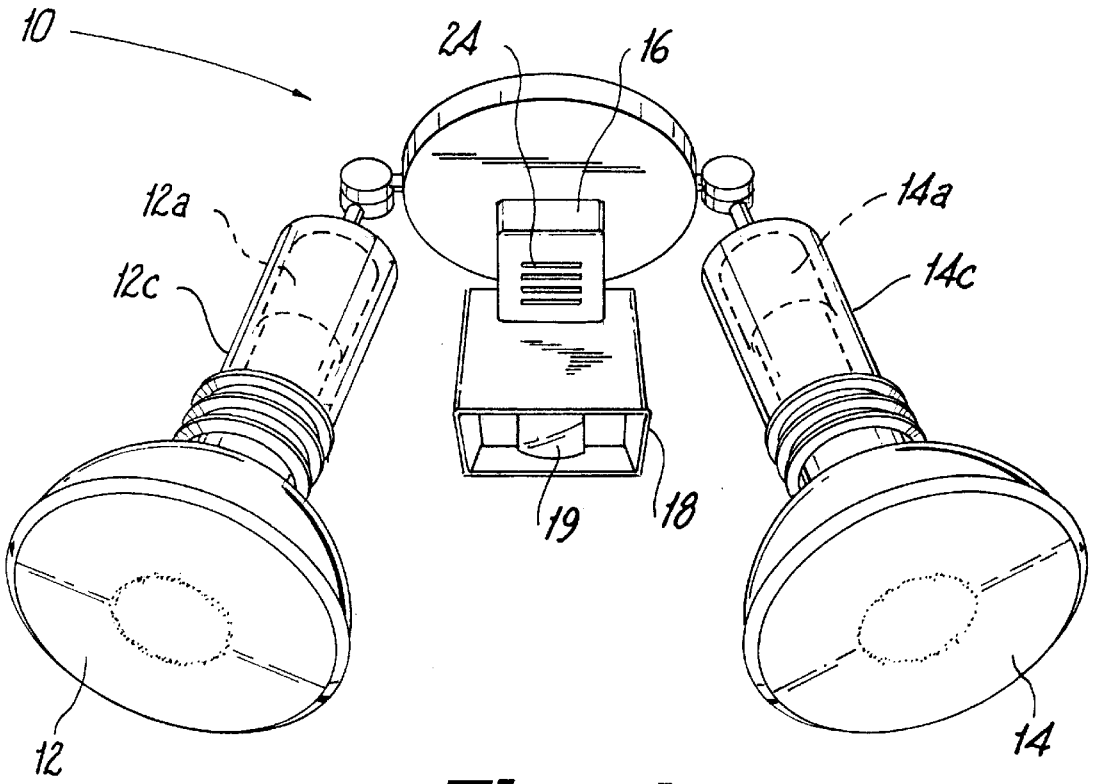
FIG. 1 is a perspective view of the flood lamp/alarm fixture of one embodiment of the present invention.
Figure 2A:
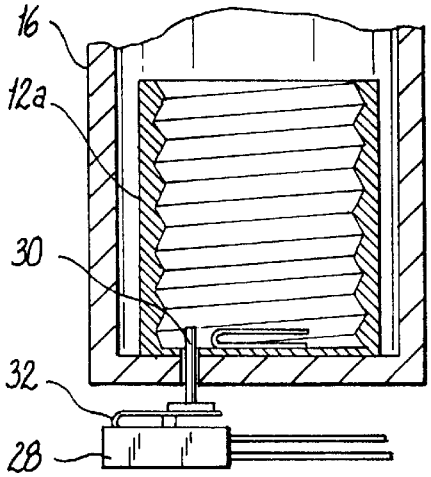
FIGS. 2A and 2B are cross section views of the socket portion of the fixture as in FIG. 1.
Figure 2B:
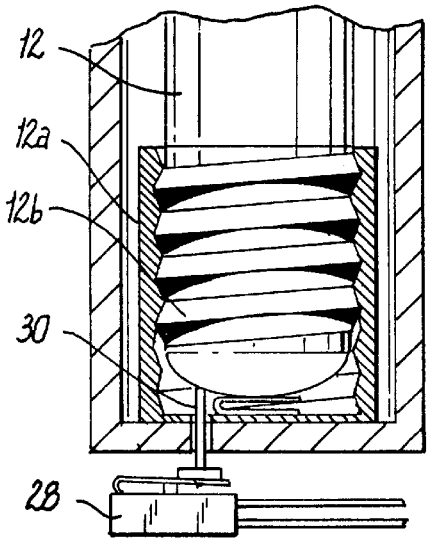
Figure 3:
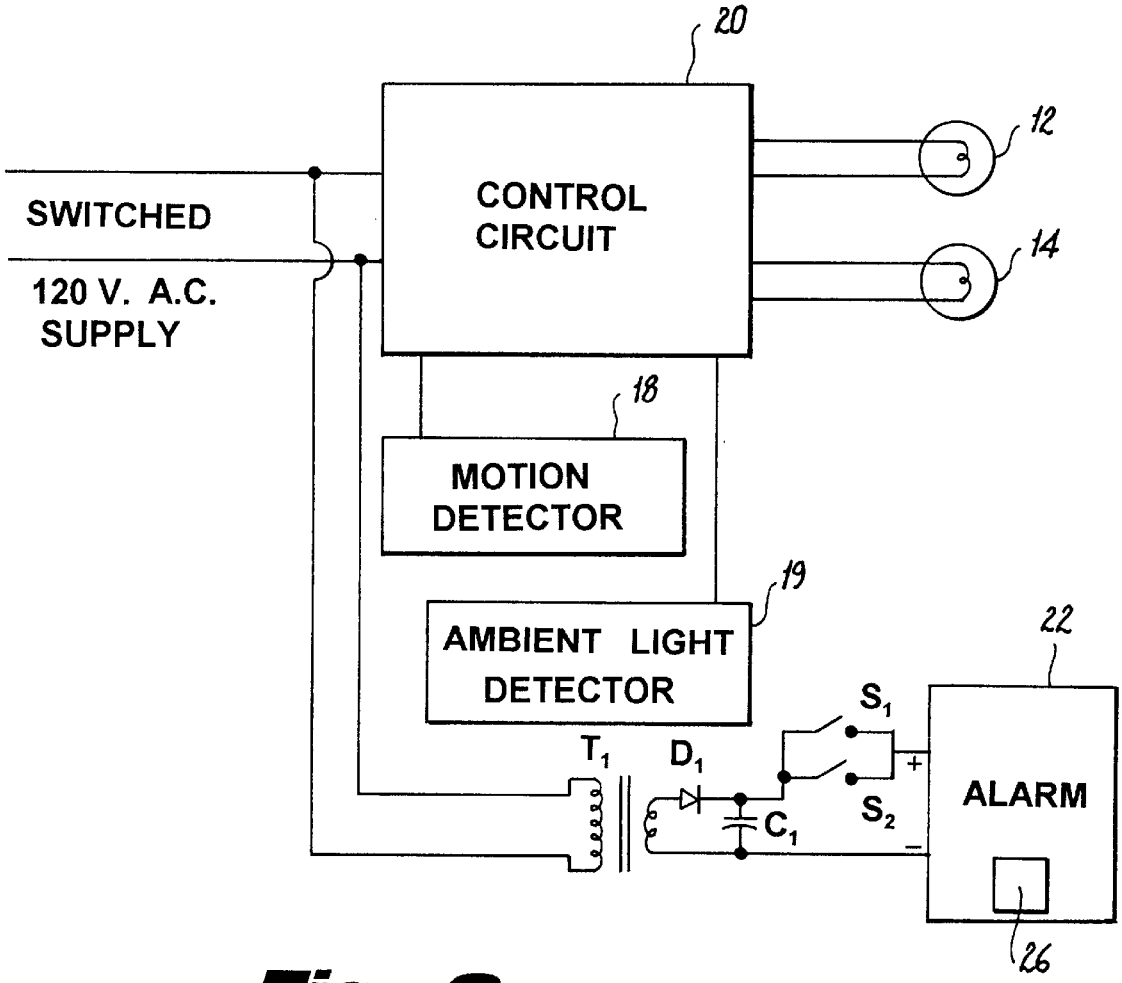
FIG. 3 is an electrical schematic diagram of the present invention as in FIG. 1.

As shown in an embodiment shown in FIGS. 1–3, FIG. 1 shows a two flood lamp security fixture 10 for a pair of flood light lamps 12, 14 screwed into sockets 12*a*, 14*a*. Sockets 12*a*, 14*a* within socket housings 12*c*, 14*c* are connected to alarm control housing 16 and conventional motion detector 18, which detects movement in low light conditions in conjunction with ambient light detector 19.

Fixture 10 appears visibly undetectable since lamp security fixture 10 looks quite ordinary. However, housing 16, which normally contains control circuitry 20, also contains audio alarm 22. Housing 16 may be somewhat larger than normal to accommodate audio alarm 22, and it may have sound escape holes or louvers 24. Audio alarm 22 itself includes electronic sound generator 26, such as an oscillator or siren type of sound generator, and either a magnetic or piezoelectric sound transducer or loudspeaker.

As shown in FIGS. 2A and 2B, a method of lamp detection is employed to trigger audio alarm 22. One method is to equip each lamp socket 12*a*, 14*a* with miniature snap-action switch 28, which switch 28 is activated by an insulating rod 30, which insulating rod 30 is physically pushed by the lamp base 12*b* or 14*b*, of lamp 12 or lamp 14, into a first predetermined position, when lamp 12 or lamp 14 is properly screwed in sockets 12*a* or 14*a*.

Detection rod 30 is pushed away from the first predetermined position to a second predetermined position by restoring spring 32 in snap-action switch 28, if lamp 12 or lamp 14 is loosened or removed, such as shown in FIG. 2A with respect to lamp 12.

In this configuration in FIG. 2A, switch 28 is in the "ON" position and audio alarm 22 is turned on, regardless of lamp 12 itself being "on" or "off".

In FIG. 2B however, detection rod 30 is pushed down by lamp 12 so that switch 28 is turned off. Snap-action switch 28 can be replaced by a photodetector in the socket housing 12*c* or 14*c* that detects the proper position of lamp 12 or lamp 14.

Another alternative retains detection rod 30 but wherein detection rod 30 actuates either a hall-effect sensor or an electronic photodetector switch, either of which is shaped like snap-action switch 28. In any event, the detection of the proper positioning of lamp 12 or 14 in their respective sockets 12*a*, 12*b* is made at this location.

FIG. 3 shows a block diagram of the security lamp system with a wiring diagram for adding the alarm feature. Here, alarm 22 is wired directly to the switch 120 volt AC line that feeds the entire fixture. Transformer T1, diode D1, and capacitor C1 form a small low voltage DC power supply to power alarm 22. The voltage output is preferably from 5 to 12 volts as appropriate.

Control circuit 20 of the security lamp system also has a DC power supply internally which is used to power alarm 22 instead of transformer T1, diode D1 and capacitor C1 if the feature is integrated with the security lamp feature.

S1 and S2 describe two single pole single throw (SPST) switches normally on snap-action switches, such as switch 28, located in lamp socket housings 12*c*, 14*c*. Switches S1, S2 are wired in parallel so that either switch S1 or switch S2 can turn alarm 22 on if either lamp 12 or lamp 14 is unscrewed or loosened from lamp socket 12*a* or lamp socket 14*a*. For a single lamp, only one switch is used. For any number of multiple lamps, there is generally one switch per socket and they are generally wired in parallel.

The homeowner can easily change lamp 12 or lamp 14 without triggering alarm 22 by simply switching the security lamp off from a conventional on-off switch inside the house.

In an alternate embodiment, shown in FIGS. 4–7, alarm 122 for lamps 112, 114 is remotely placed away from security lamp fixture 110. This necessitates the use of a cable connection 140 from alarm 122 to security lamp fixture 110, as in FIG. 4, unless an alternate wireless communication scheme is used from fixture 110 to alarm 122. The latter can be a radio frequency or infrared communication link from the sensors in lamp fixture 110 to the alarm triggering circuit.

Another "wireless" option is to use the power wiring itself (house 120V AC wiring) as the signaling connection. A typical sophisticated encoding scheme that puts a signal carrier onto the power wiring is manufactured by ECHELON Corporation.

In the remaining description, cable connection 140 is described. Cable connection 140 is preferably hidden or armored so that it would be difficult to tamper with it.

Two alternate powering schemes are shown for remote alarm 122. One is an AC connection through a wall mounted alarm defeat switch 152 inside the house.

A second approach is to feed low voltage DC from inside the house either provided by battery pack 154 or an AC connected power supply. This alternative simplifies wiring to alarm 122 since only low voltage DC need be wired, as a safety consideration. This latter alternative has alarm defeat switch 152 mounted on the power supply or battery pack 154. In any event, defeat switch 152 is required to permit the homeowner to change lamps 112, 114 in fixture 110 without triggering alarm 122.

Figure 6:
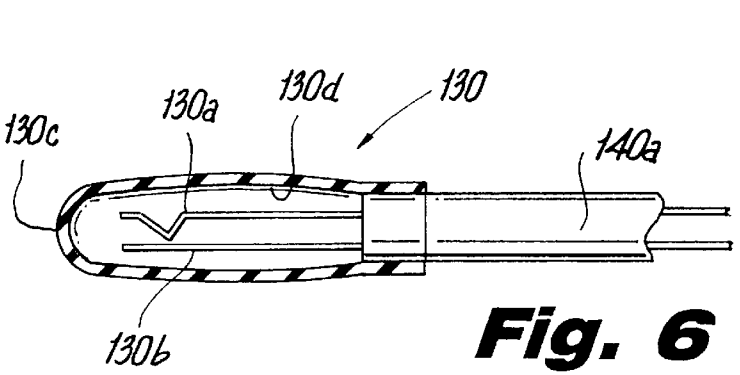
FIG. 6 is a close-up view of the compressive switch element as in FIG. 4.
Figure 5:
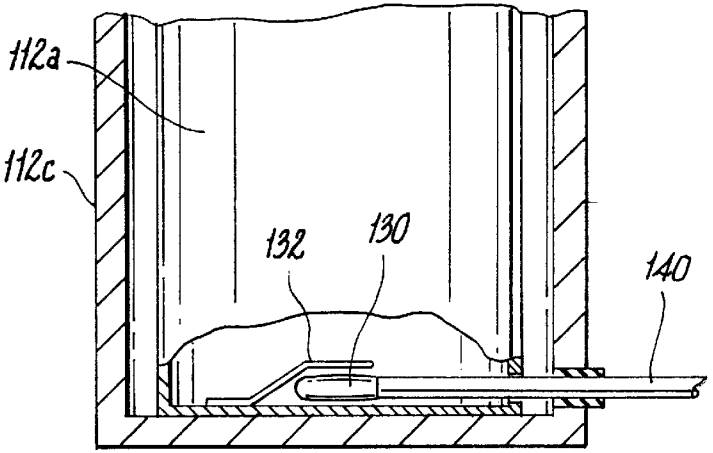
FIG. 5 is a cross section view of the system as in FIG. 4.

FIG. 5 shows a cross section of an ordinary lamp socket 112*a* of housing 112*c* modified to include a compressive switch lamp screw-down detection element 130. A hole is drilled through the side of socket housing 112*c* and through the lamp screw socket connector 112*a* at the level of the center spring contact 132. Compressive switch element 130, as in FIG. 6, is slid through this access hole placing switch element 130 directly under spring contact 132. Switch connecting cable 140 is then sealed with an elastomeric sealant around its entry to socket housing 112*c*.

FIG. 6 reveals that compressive switch element 130 is simply a spring contact 130*a* and a rigid contact 130*b* encased in an elastomeric bulb 130*c*, which is sealed around contact housing 130*d* and sensor cable insulation 140*a*. The material of bulb 130*c* as well as cable insulation 140*a* in the vicinity of the lamp socket 112*c* must be high temperature insulators such as silicone material.

The operation of the compressive switch 130 is such that contacts 130*a*, 130*b* are closed when lamp 112 is properly screwed into socket 122*a*. Contacts 130*a*, 130*b* open and break an electrical circuit if lamp 112 is loosened or removed. Although switch 130 itself in an SPST normally open type, in operation with lamp 112 screwed in, switch 130 will be in the "ON" position.

Figure 7:
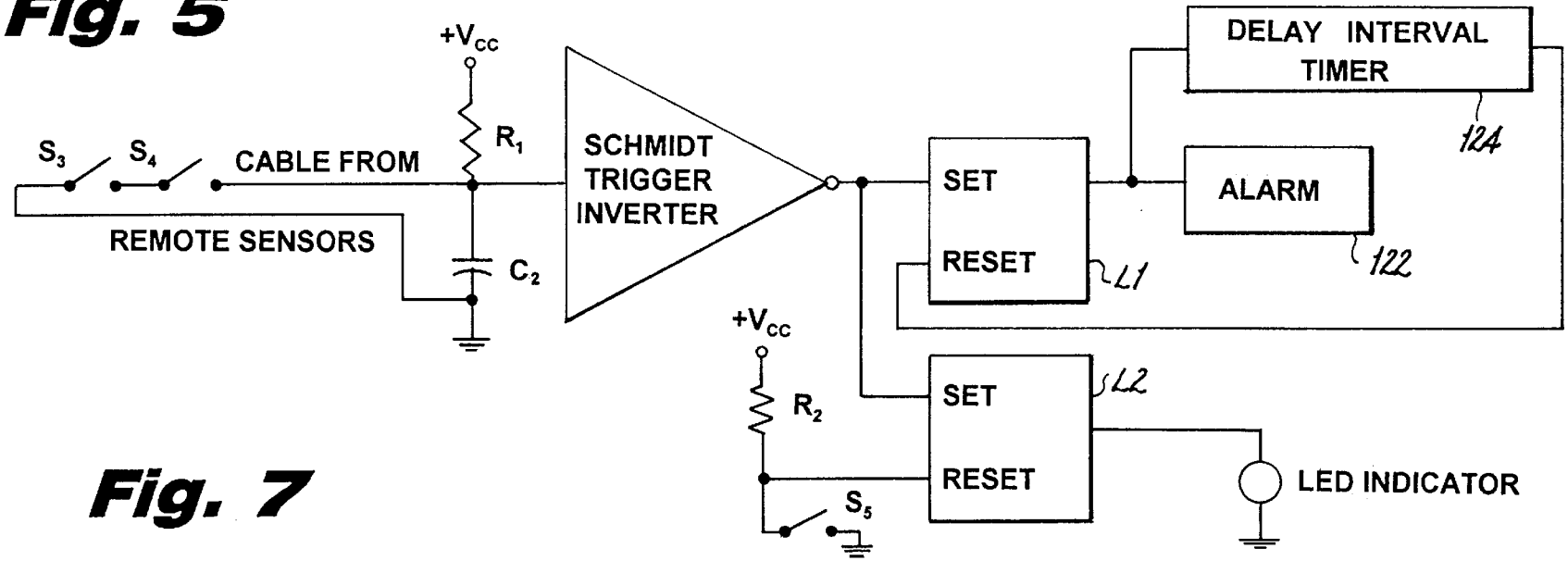
FIG. 7 is an electrical schematic of the alarm triggering as in FIG. 4.

Therefore, if multiple switches 130 are used to detect loosening in multi-lamp fixtures, they are preferably wired in series as shown in FIG. 7, such as S3, S4. In this way if any one lamp 112 is loosened, or if the cable is cut, alarm 122 will be triggered.

FIG. 7 shows an alarm triggering circuit with several features. It is assumed that sensor switches S3, S4 are of the compressive switch type. A simple circuit change easily accommodates one or more switches S3, S4, wired in parallel of the type shown in FIGS. 2 and 3.

The triggering circuit detects any attempted tampering even if lamp 112 is quickly screwed back in. Alarm 122 stays on for a period of time determined by the delay interval timer 124 and a tell-tale indicator lamp or light emitting diode (LED) remains on until manually turned off by the homeowner, indicating that alarm 122 had been triggered.

There are many possible implementations of this control scheme. FIG. 7 shows one embodiment. The circuit consisting of resistor R1, capacitor C2 and a "schmidt" trigger inverter I form a signal conditioning circuit for the two sensor switches, S1 and S2. The inverter I is preferably an SN74HC14 type from Texas Instruments, for example. Resistor R1 can bias the input to the inverter I "HIGH", except for the fact that S1 and S2 are usually closed, thereby shorting this input to ground.

Capacitor C2 is used to "quiet" the circuit, making it more immune to minor disturbances, such as lightning or power interferences that may disturb long sensor cable 140. If lamp 112 is loosened, one of the switches opens, thereby permitting resistor R1 to pull up the inverter I input. Although capacitor C2 will slow this transition, the use of a "schmidt" trigger type of inverter insures a crisp "HIGH" to "LOW" transition at the output of inverter I, which sets latches L1 and L2, since these are of the "low edge triggered" variety.

Even if the input condition goes away, e.g. lamp 112 is quickly screwed back in, latches L1, L2 remain set. Latch L1 immediately sets off alarm 122 for a period determined by delay interval timer 124 which then resets latch L1. However, latch L2 stays on, powering the LED until the user manually presses the momentary SPST switch S5 to reset the latch L2, thereby turning the LED off. The LED and switch S5 are preferably in an accessible location, such as on an indoor panel or power supply.

Figure 4:
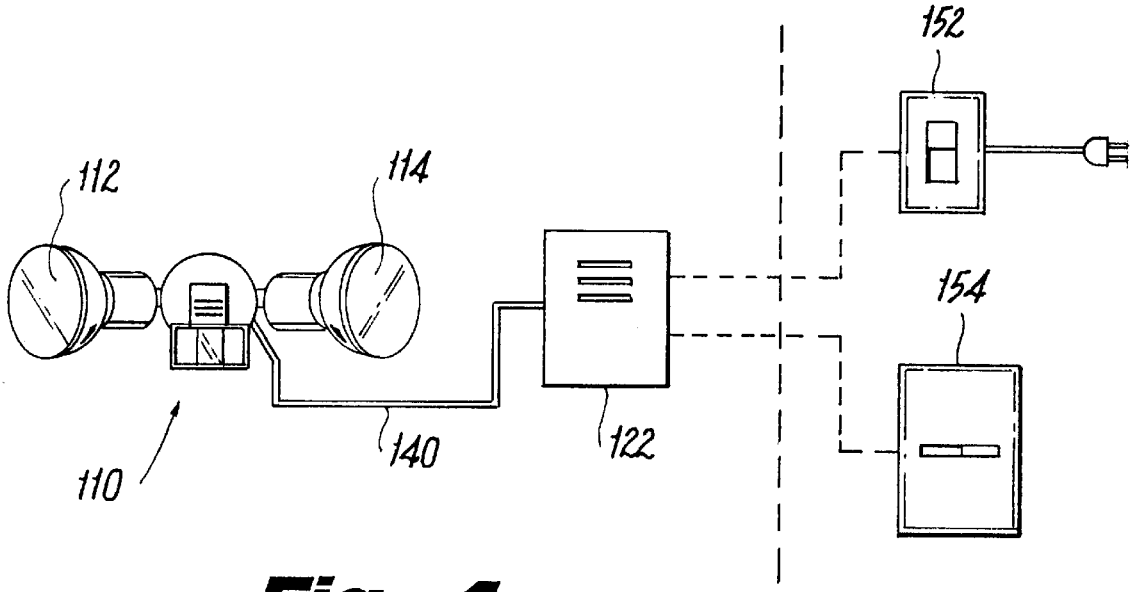
FIG. 4 is a perspective view of an alternate remote alarm system.
Figure 8:
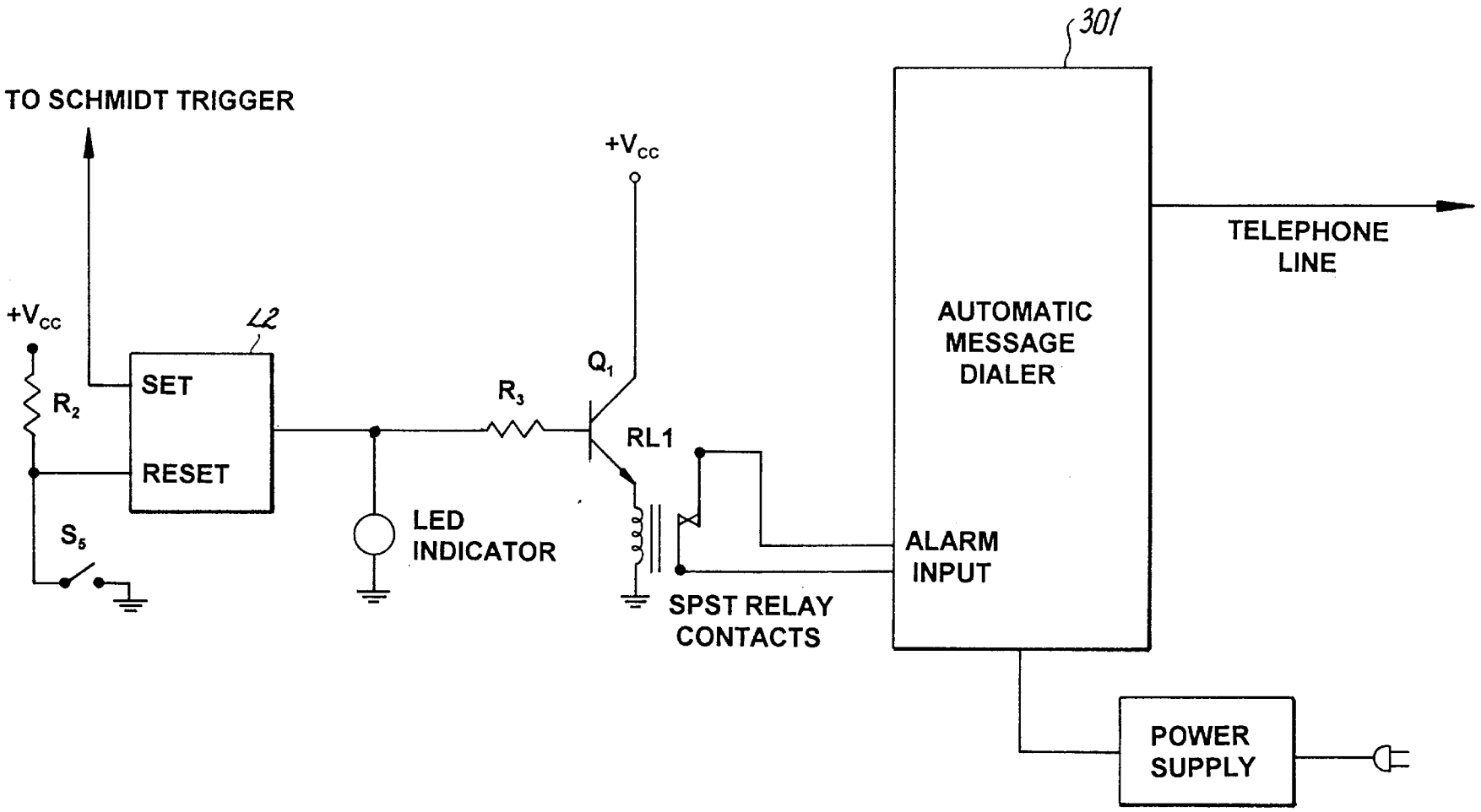
FIGS. 8 is a block diagram of an automatic dialer interface for the present invention as in FIG. 1 or FIG. 4.

FIG. 8 shows an automatic dialing feature for either of the embodiments in FIG. 1 or FIG. 4. Stand-alone automatic message dialers have been commercially available for some time. A model 49-434 from Radio Shack is currently available. By adding automatic dialer 301 to the basic alarm circuit shown in FIG. 7, the flood lamp removal alarm 122 is able to automatically dial up to three phone numbers automatically. The unit is attached to its own power supply and to the telephone line. It has a numeric keyboard for entering the phone numbers and a digital recorder with built-in microphone for recording a short phone message to be sent.

FIG. 8 shows the interface circuitry required to connect dialer 301 to the flood light alarm removal alarm 122. The dialer input is set up to monitor "contact closure". A pair of normally closed single pole contacts (SPST) on relay RL1 are used to trigger the automatic message dialer 301. Relay RL1 is driven by an emitter-follower amplifier consisting of a transistor (Q1), such as an NPN transistor and a base resistor (R3). Relay RL1 is energized whenever the LED indicator is turned on by latch L2. This, in turn, causes contacts 130*a*, 130*b* to open, thereby triggering automatic message dialer 301. By turning off audible alarm 122, or eliminating it, flood lamp removal alarm 122 can function as a "silent alarm" dialing the appropriate authorities.

Other types and models of automatic message dialers are also available. Some may not require the relay as part of the interface. Also, the entire function of the stand-alone dialer can be built into the flood lamp removal alarm.

Conventional lamp sockets have a central contact with a short throw; it includes of a short leaf spring which loses contact with the lamp central contact when the lamp is loosened a short distance. A lamp removal detector switch which senses vertical motion of the lamp bottom away from this contact should be quite sensitive, i.e. a short throw, and should be adjusted well to reliably detect the loosening of a lamp before it is disabled. Another problem is that false triggering may result if a lamp is replaced but not screwed in tightly enough to trigger the switch to its normal position (even though the lamp may light).

Figure 9:
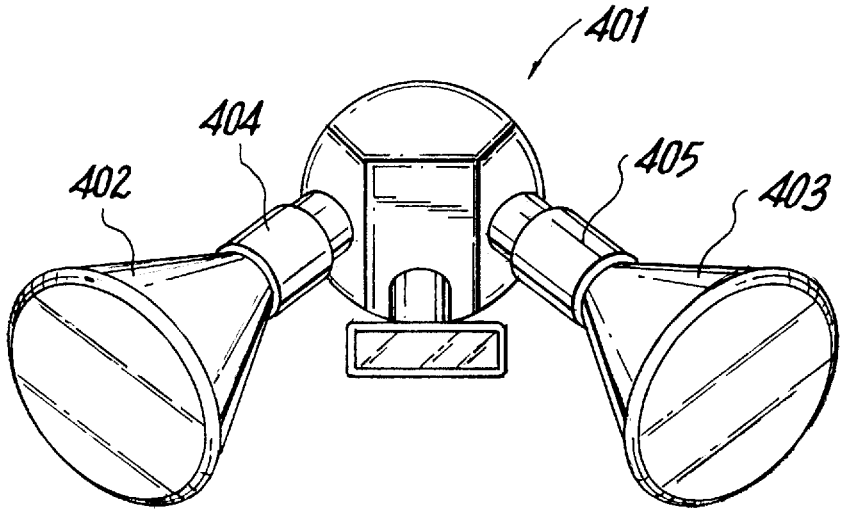
FIG. 9 is a front view of a second alternate embodiment for a lamp fixture of the present invention.

FIG. 9 shows lamp fixture 401 with flood light lamp 402 screwed within socket 404, and lamp 403 screwed within socket 405.

Figure 9A:
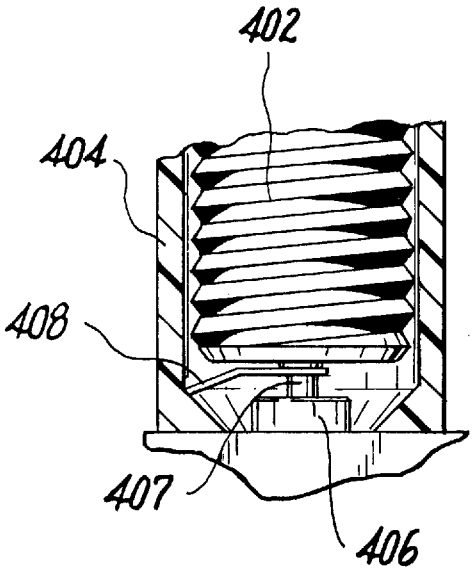
FIG. 9A is a detail of a socket of the lamp fixture as in FIG. 9, shown with a lamp screwed in tight.
Figure 9B:
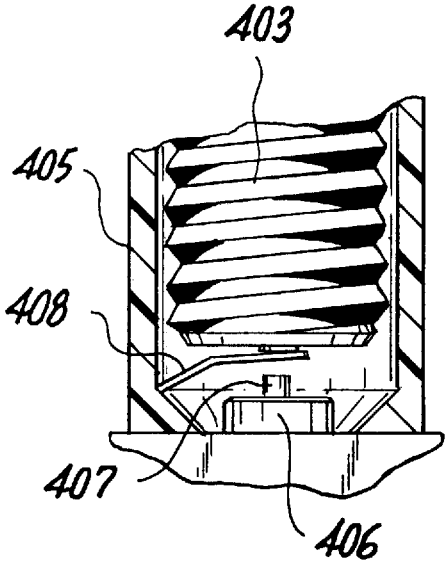
FIG. 9B is a detail shown of a socket of the lamp fixture as in FIG. 9, shown with a lamp loosened.

FIGS. 9A and 9B show details of a modified type of lamp socket which uses a longer leaf spring 408 with an extended contact range to overcome these problems, wherein lamp fixture 401 is shown with lamps 402 and 403 in sockets 404 and 405 respectively. For example, a conventional leaf spring is about ¾ to ⅞ inch in length, wherein the oblique portion is roughly ⅜ to ½ inch and the horizontal bulb contact portion is ⅜ inch. However, in the present invention, the oblique portion, as shown in FIGS. 9A and 9B, is increased by about 30 to 50 percent in length, or about ½ to ¾ inch more, to increase the contact time as a bulb is being removed, so the alarm can go off before the lamp goes off.

In FIG. 9A, the lamp removal switch 406 of socket 404 is shown with button 407 depressed by lamp 402 through leaf spring 408. This is the "no alarm" position.

On the other hand, FIG. 9B shows the situation with lamp 403 of socket 405 somewhat partially unscrewed. Button 407 on lamp removal switch 406 is fully extended even though contact 408 is still connected to lamp 403, thereby lighting lamp 403.

Therefore, if a person unscrews lamp 403 for the normal amount of unscrewing that would disconnect lamp 403 from socket 405, lamp 403 might actually not be disconnected and alarm switch 406 will be triggered reliably.

This "partial unscrewing" alarm feature is desirable even if a lamp removal switch and alarm is not used. A user familiar with the socket is just cautioned to continue screwing lamp 403 further after a slight resistance is first encountered, to reset removal switch 406. Switch 403 may alternatively have a longer throw that can be used, and therefore it would not have to be as accurately adjusted.

Figure 10:
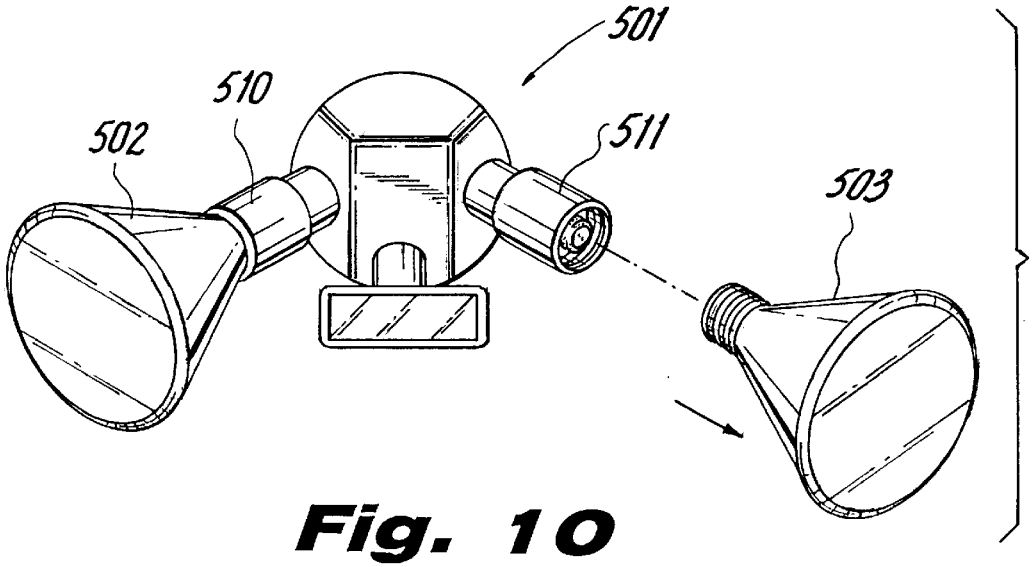
FIG. 10 is a front view of a third alternate embodiment for a lamp fixture of the present invention.

FIG. 10 shows an alternate embodiment that goes farther with the extended contact concept, such that lamp 502 of socket 510 or lamp 503 of socket 511 each are in contact with respective switches 506 until each lamp 502 or 503 is physically removed from respective sockets 510 or 511. This feature is useful even without a removal sensor switch and alarm. A person tampering with lamp 502 or lamp 503 to loosen lamp 502 or lamp 503, so that lamp 502 or lamp 503 do not light, would literally have to remove either lamp 502 or lamp 503 completely, which is easily visible, before lamp 502 or lamp 503 cease to light.

Figure 10A:
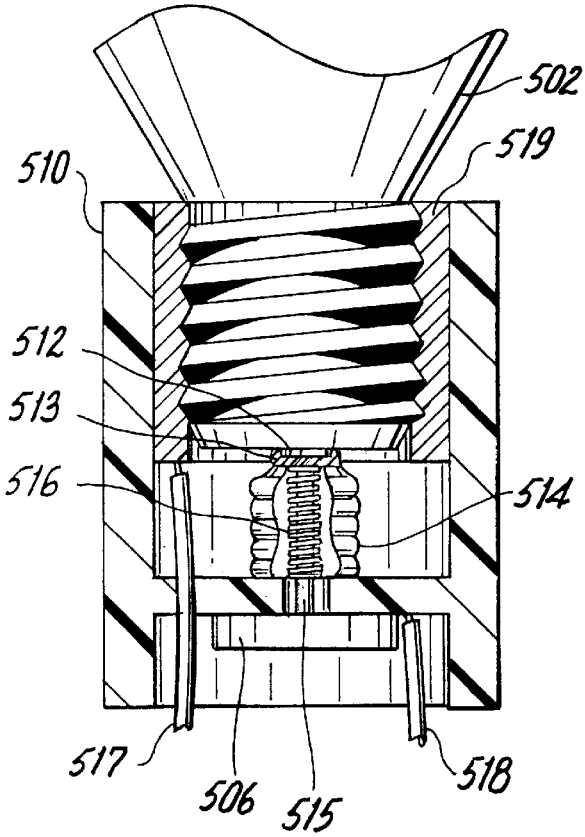
FIG. 10A is a detail of a socket of the lamp fixture as in FIG. 10, shown with a lamp screwed in tight.
Figure 10B:
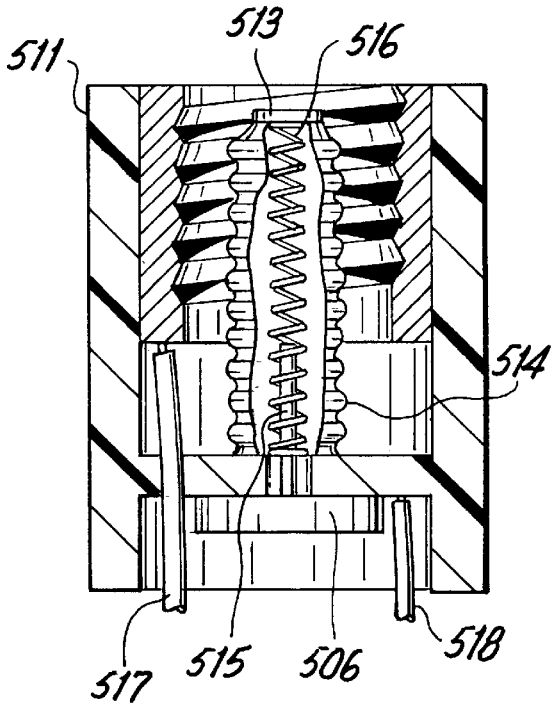
FIG. 10B is a detail of a socket of the lamp fixture as in FIG. 10, shown with a lamp removed.

In FIG. 10A, lamp 502 is shown screwed in tightly in socket 510, while in FIG. 10B, lamp 503 is shown removed from socket 511.

In FIG. 10A, socket 510 includes central contact 513 that is attached to coil spring 516, which carries the lamp current. Narrow actuator rod 515 on removal sensor switch 506 is threaded through the center of coil spring 516. Narrow actuator rod 515 tends to keep coil spring 516 from deforming sideways.

A high temperature insulating bellows 514 is shown in cross section. Insulating bellows 514 can be molded of a material, such as silicone. Insulating bellows 514 is used to prevent any chance of a short circuit with side lamp contact 519. Alternatively, a three-sectioned telescoping cylinder can be used as a replacement for the bellows. Insulated leads 517 and 518 complete the circuit to power lamp 502 or lamp 503.

FIG. 10A shows rod 515 in its compressed "no alarm" position.

In contrast, FIG. 10B shows when lamp 503 is removed from socket 511, and the central contact 513 of socket 511 is totally extended almost to the top of side contact 519. Central contact 513 has a depression in its top to help center it and engage the center lamp contact 512 of lamp 502. Rod 515 is now fully extended and switch 516 is in its "alarm" condition.

Figure 11:
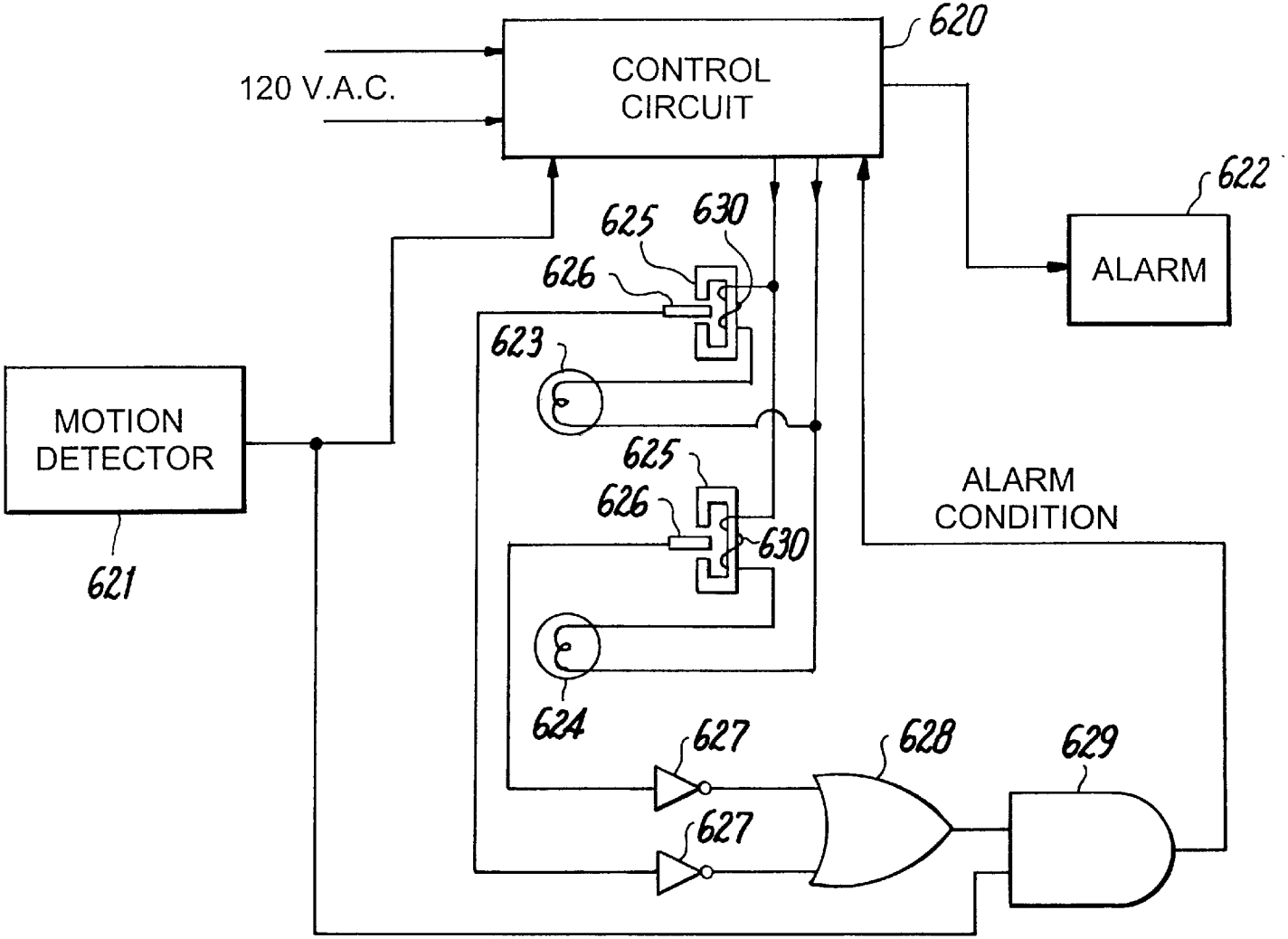
FIG. 11 is a block diagram and logic of a fourth alternate embodiment of the present invention, shown with current sensors.

FIG. 11 shows an alternate embodiment with the alternate use of, or the addition of, current sensors to the lamp security system. In this embodiment, motion detector 621 signals control circuit 620 to turn on lamps 623 and 624. A separate current sensor 626 is used for each lamp 623 or 624 in this diagram. An alternate embodiment using a single sensor 626 that can sense the difference between the current of both lamps 623 and 624 and that of a single lamp 623 or 624 can also be used.

Current sensors 626 used are preferably Hall effect switches 626, which sense the magnetic field in the open gap of each ferrite core 625, due to current flowing in a few turns of conductor 630 wound around each core 625.

Therefore, if lamp 623 or lamp 624 were missing, loosened, or burned out, no current would flow in respective associated coils 630 and each sensor 626 would be in an "Off" state.

Alternate sensor technologies such as current sensing relays or a low value resistor in series with each lamp 623 or 624 with an op-amp type comparator sensing the voltage drop across it can be used as well. In this embodiment, the output of each sensor 626 is inverted in respective inverters 627 and then the two signals are logically OR'ed in block 628. The output is AND'ed with the motion detector "activate" signal in block 629 to form the alarm condition signal to the control circuit. The sensors and logic blocks are actually part of the control circuit but are shown externally for clarity. The logic blocks may preferably be "74COO" series CMOS integrated circuits such as those available from National Semiconductors Inc. In this manner, if either lamp 623 or 624 is inoperative, or both, when motion detector 621 is calling for them to be activated, the control circuit sounds the alarm.

Current sensors 626 of the current sensing embodiment of FIG. 11 can be used in addition to lamp removal sensor switches 406 OR 506 or instead of them.

Moreover, current sensors 626 do not sense a problem until motion detector 21 is triggered, while lamp removal sensor switches 406 or 506 do not detect a burned out bulb, but they operate independently of motion sensor 621. Thus better coverage is afforded if both types of these embodiments are used together.

Figure 12:
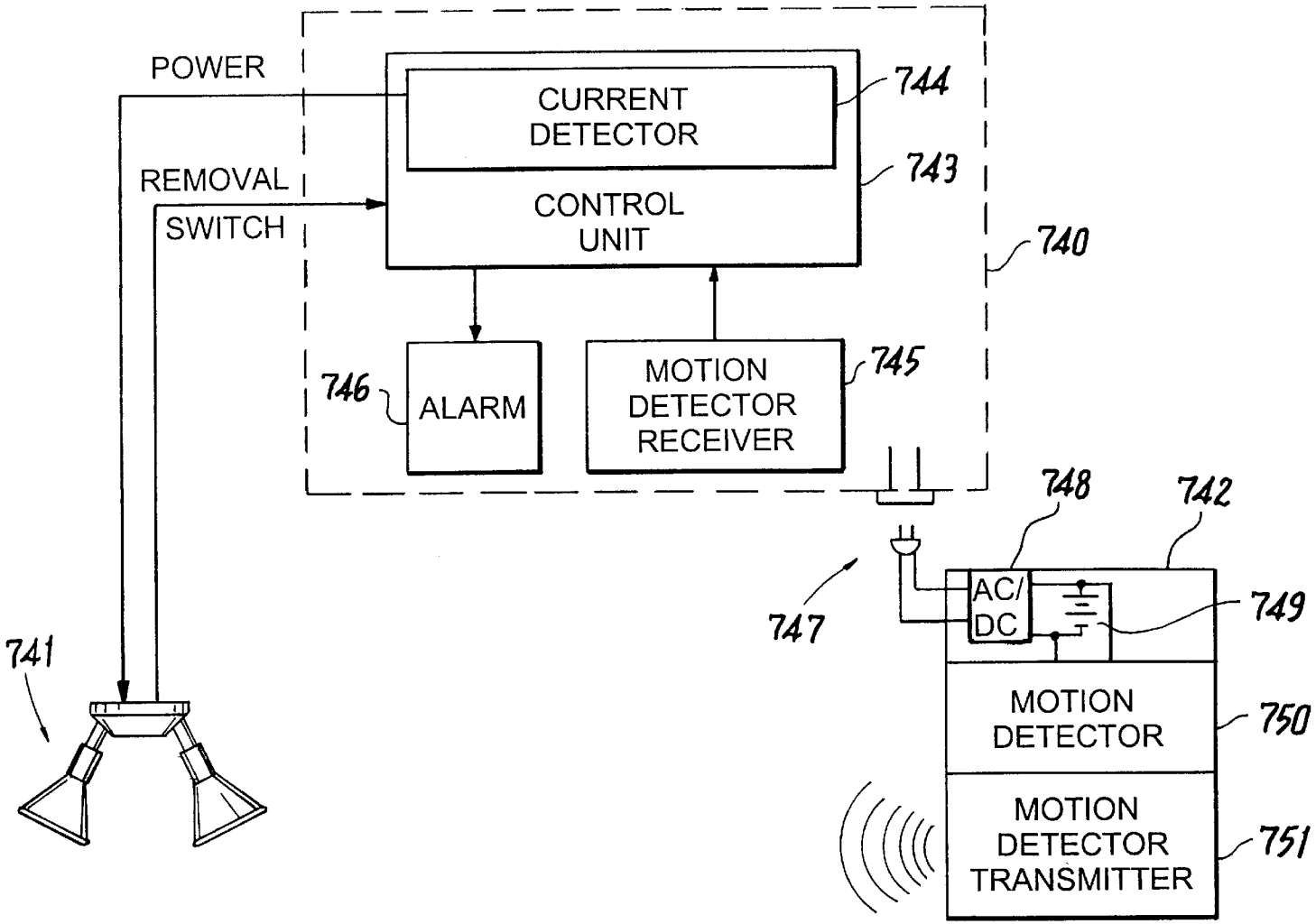
FIG. 12 is a block diagram of a fifth alternate embodiment of the present invention, for a distributed lamp security system.

FIG. 12 shows a layout for a further alternate embodiment for a distributed lamp security system. The perimeter of a dwelling or building, such as house 740, shows a motion detector (MD) subassembly 742 mounted remotely from lamp fixture 741. Control unit 743 and alarm 746 are located inside house 740. Plug 747 supplies 120 volts AC to power motion detector (MD) subassembly 742. Control unit 743 supplies power to lamps of lamp fixture 741 through current detector (CD) 744 if motion is detected by motion detector 750. Motion detector (MD) transmitter 751 alerts control unit 743 with a coded burst of radio signals which are received in a wireless fashion by motion detector (MD) receiver 745 inside house 740. Since motion detector 750 is powered through an AC to DC converter 748 with a storage battery 749 on "float charge", motion detector 750 functions for a number of hours even if the power line to motion detector 750 is cut.

Similarly, if the power line is cut to lamp fixture 741, current detector 744 will sound the alarm the very next time motion detector 750 is triggered. Current detector 744 senses the difference between the current of both lamps of fixtures 741 and that of only one. Current detector 744 triggers an alarm set condition if less than full 2-lamp current is detected. This alarm set condition turns into an alarm signal if it happens simultaneously with a signal burst of motion detector 750.

The above examples are illustrative of the concept described in the preferred embodiments. However, other embodiments may be made to the present invention for a flood light lamp removal alarm.

I claim:

1. A flood light lamp removal alarm assembly for home security flood light fixtures having at least on one socket accommodating at least one flood light lamp, said socket connected to a power supply for the lamp, the fixture having a low ambient light detector and a motion detector, wherein the assembly detects unwarranted unscrewing of the flood light lamp therefrom, comprising:

a housing containing a perceptible alarm;

a means for detecting removal of the lamp, said means comprising the lamp socket having a physical condition sensor therein, which physical condition sensor is inactivated when said lamp is properly screwed into said socket, said physical condition sensor being activated when the lamp is loosened or removed from the socket;

said sensor comprising a switch mounted in the bottom of said socket positioned in such a manner that when said lamp is properly screwed into said socket, said switch is depressed in the closed position;

an electrical circuit means being connected to said switch for triggering said alarm when said switch is released as a result of loosening or removal of said lamp from said socket, said alarm remaining inactive as long as said switch remains depressed by said lamp; and, said socket being provided with resilient electrical contact means for maintaining lamp-illuminating electrical contact during a partial removal of said lamp from said socket, while providing for said triggering of said lamp removal alarm even while said partially removed lamp remains illuminated by electrical contact with said resilient contact means.

2. The flood light lamp removal alarm assembly of claim 1 where said resilient electrical contact means comprises an elongated leaf spring for maintaining electrical contact with said lamp respectively during the loosening or partial withdrawal of said lamp from said socket.

3. The flood light lamp removal alarm assembly as in claim 2 wherein said physical condition sensor means further comprises an electric circuit separate from the lamp illuminating electrical circuit, said physical condition sensor circuit further comprising a switch having a push-button disposed in the bottom of the socket respectively;

said push button having a short throw compressible when pressed upon by a fully seated and tightened lamp in said socket;

said switch having a no-alarm condition when said push-button is depressed by a fully-seated lamp; and, said switch having an alarm condition when said push button is not compressed due to the absence of a fully seated condition of said lamp.

4. The flood light lamp removal alarm assembly as in claim 2, wherein an oblique portion of said leaf spring is increased in length by 30–50 percent.

5. The flood light lamp removal alarm assembly as in claim 1 wherein said resilient electrical contact means comprises an electrically conductive coil spring.

6. The flood light lamp removal alarm assembly as in claim 5 wherein said coil spring has a central electrical contact in combination with and surrounded by an electrically insulating compressible sleeve;

said coil spring and bellows sleeve combination being mounted within said socket for extensible electrical contact of said lamp with said central contact for providing illuminating current during partial removal of the lamp from the socket.

7. The flood light lamp removal alarm assembly as in claim 6 wherein said physical condition sensor means further comprises an electric circuit separate from said lamp illuminating electrical circuit, said physical condition sensor circuit further comprising a switch having an electrically insulated narrow actuator rod disposed in a bottom of said socket;

said narrow actuator rod having a throw and being compressible when pressed upon by a fully seated and tightened lamp in said socket;

said switch having a no-alarm condition when said narrow actuator rod is depressed by a fully-seated lamp; and said switch having an alarm condition when said narrow actuator rod is not compressed due to the absence of a fully seated condition of said lamp.

8. The flood light lamp removal alarm assembly as in claim 6, wherein said compressible sleeve is a bellows.

9. The flood light lamp removal alarm assembly as in claim 6 wherein said compressible sleeve is a telescoping cylinder.

10. The flood light lamp removal alarm assembly as in claim 6 wherein said compressible sleeve is made of silicone.

* * * * *